US010456656B2

(12) United States Patent
Deal

(10) Patent No.: US 10,456,656 B2
(45) Date of Patent: Oct. 29, 2019

(54) HAMMER/DISCUS CAGE

(71) Applicant: Lance Deal, Eugene, OR (US)

(72) Inventor: Lance Deal, Eugene, OR (US)

( * ) Notice: Subject to any disclaimer, the term of this patent is extended or adjusted under 35 U.S.C. 154(b) by 0 days.

(21) Appl. No.: 16/223,453

(22) Filed: Dec. 18, 2018

(65) Prior Publication Data

US 2019/0192948 A1 Jun. 27, 2019

Related U.S. Application Data

(60) Provisional application No. 62/609,031, filed on Dec. 21, 2017.

(51) Int. Cl.
*A63B 71/00* (2006.01)
*A63B 71/02* (2006.01)
*A63B 61/04* (2006.01)

(52) U.S. Cl.
CPC ..... *A63B 71/022* (2013.01)

(58) Field of Classification Search
CPC ..... A63B 71/00; A63B 71/022; A63B 3/00; A63B 61/00; A63B 61/04; A63B 69/00; A63B 69/0079
USPC ..... 472/92, 94; 473/421, 490, 492, 494; 273/400, 411
See application file for complete search history.

(56) References Cited

U.S. PATENT DOCUMENTS 1,591,753 A * 7/1926 Flaugh ..... A63B 63/00 256/26
2,292,109 A * 8/1942 Engel ..... A63B 63/00 473/421
3,408,071 A * 10/1968 Lundy ..... A63B 71/022 473/421
5,577,721 A * 11/1996 Hardee ..... A63B 71/022 473/421
5,738,588 A * 4/1998 Esser ..... A63C 19/00 256/24
7,001,288 B2 * 2/2006 Harrell ..... A63B 63/00 119/452
8,875,772 B1 * 11/2014 Dixon, Jr. ..... A63B 71/022 160/180
2006/0293124 A1 * 12/2006 Mooney ..... A63B 69/0079 473/421

* cited by examiner

*Primary Examiner* — Kien T Nguyen
(74) *Attorney, Agent, or Firm* — Iandiorio Teska & Coleman, LLP

(57) ABSTRACT

A hammer/discus cage includes first and second base plates, first and second vertical trusses coupled to their respective first and second base plates, and first and second gates hinged to their respective first and second vertical trusses. A hoop net rail extends rearwardly from the first vertical truss to the second vertical truss and netting extends downward from the hoop net rail and attached to the first and second gates.

26 Claims, 5 Drawing Sheets

HAMMER/DISCUS CAGE

RELATED APPLICATIONS

This application claims benefit of and priority to U.S. Provisional Application Ser. No. 62/609,031 filed Dec. 21, 2017, under 35 U.S.C. §§ 119, 120, 363, 365, and 37 C.F.R, § 1.55 and § 1.78, which is incorporated herein by this reference.

FIELD OF THE INVENTION

This subject invention relates to hammer and/or discus cages used in track and field practices and meets.

BACKGROUND OF THE INVENTION

Hammer and discus cages are used to stop or capture errant implements thrown by an athlete in order to protect spectators.

Prior art hammer and discus cages typically include net frame members set in concrete footings buried in the ground. As such, prior cages were difficult to install, could not be easily moved, and accordingly every track venue required its own hammer cage and discus cage. When not in use, the cages often block the views of spectators and media personnel.

BRIEF SUMMARY OF THE INVENTION

Featured is a new hammer or discus cage that can be raised and lowered relatively quickly without the use of heavy machinery. Preferably, no concrete footings are required and thus the cage is portable. In some embodiments, the cage can collapse to a standing structure that is 10 meters wide by 1 meter tall by one meter deep to protect the cage from wind and/or to enable better spectator and press viewing. The netting of the cage can be easily removed to protect against vandalism, theft, or damage (e.g., due to ultraviolet radiation) when not in use.

Featured is a hammer/discus cage comprising first and second base plates and first and second vertical trusses coupled to their respective first and second base plate. First and second gates are hinged to their respective first and second vertical trusses. A hoop net rail extends rearwardly from the first vertical truss to the second vertical truss. Netting extends downward from the hoop net rail and is attached to the first and second gates.

In one example, ballast is secured to the first and second vertical trusses. The cage may further include a member extending between the first and second vertical trusses. Preferably each gate includes a top rail and a bottom rail hingely attached to a vertical truss and at least one vertical post connected to the top and bottom rails. Each gate may include a net rail attached to the netting and the gate net rail is preferably supported by one or more cables for lowering the gate net rail. An angled bracket attached to the gate vertical post and an angled bracket attached to the vertical truss can be used to support the gate not rail via said one or more cables.

The cage, in one design, further includes a strut extending from each base plate to the hoop net rail, one or more cables extending from each truss to its respective gate, and/or one or more cables extending from each truss to the hoop net rail. There may also be a bottom rib assembly for the netting. Each vertical truss is preferably hingedly attached to its respective base plate.

Also featured is a hammer/discus cage comprising first and second base plates, first and second vertical trusses coupled to the respective first and second base plates, first and second gates each including a top rail and a bottom rail hingely attached to a vertical truss and at least one vertical post connected to the top and bottom rails, first and second gate net rails supported by brackets, a hoop net rail extending rearwardly from the first vertical truss to the second vertical truss, and netting extending downward from the hoop net rail and each gate net rail.

The first and second vertical trusses are preferably tied together. The first and second net rails are preferably supported by one or more cables for lowering the first and second net rails via winches.

Also featured is a hammer/discus cage comprising first and second base plates each including a bottom plate with a top member hinged thereto, the top member releasably lockable to the bottom plate, a vertical truss fastened to the top member of each base plate, a hoop net rail supported by the vertical trusses, a gate hingedly attached to each vertical truss, and netting supported by the first and second gates and the hoop net rail.

Each base plate preferably includes a receiving structure such as a yoke for a hoop net rail truss. The hoop net rail is preferably attached to the vertical trusses via u-joints.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
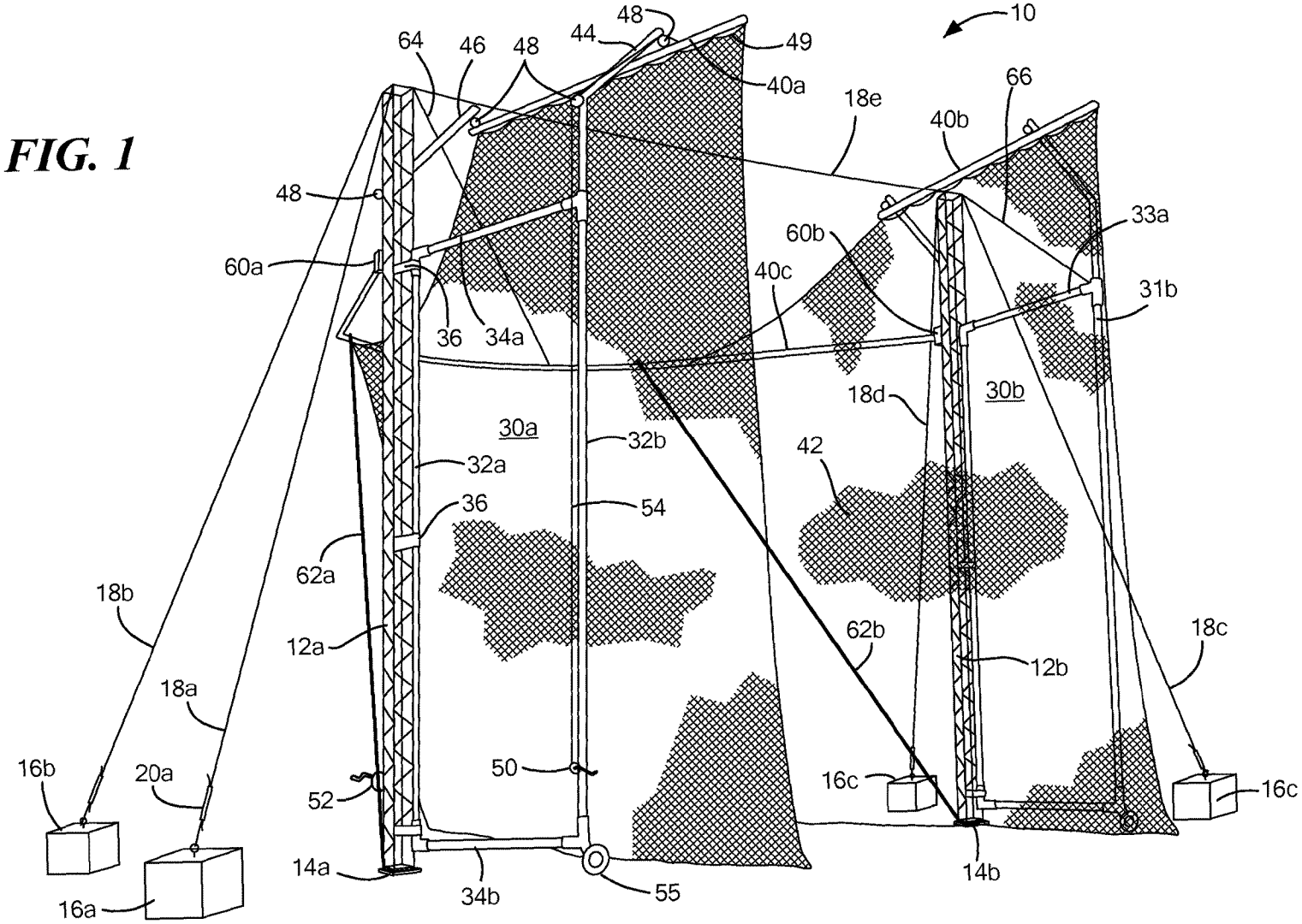
FIGS. 1-3 are schematic views showing an example of a cage in accordance with the invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
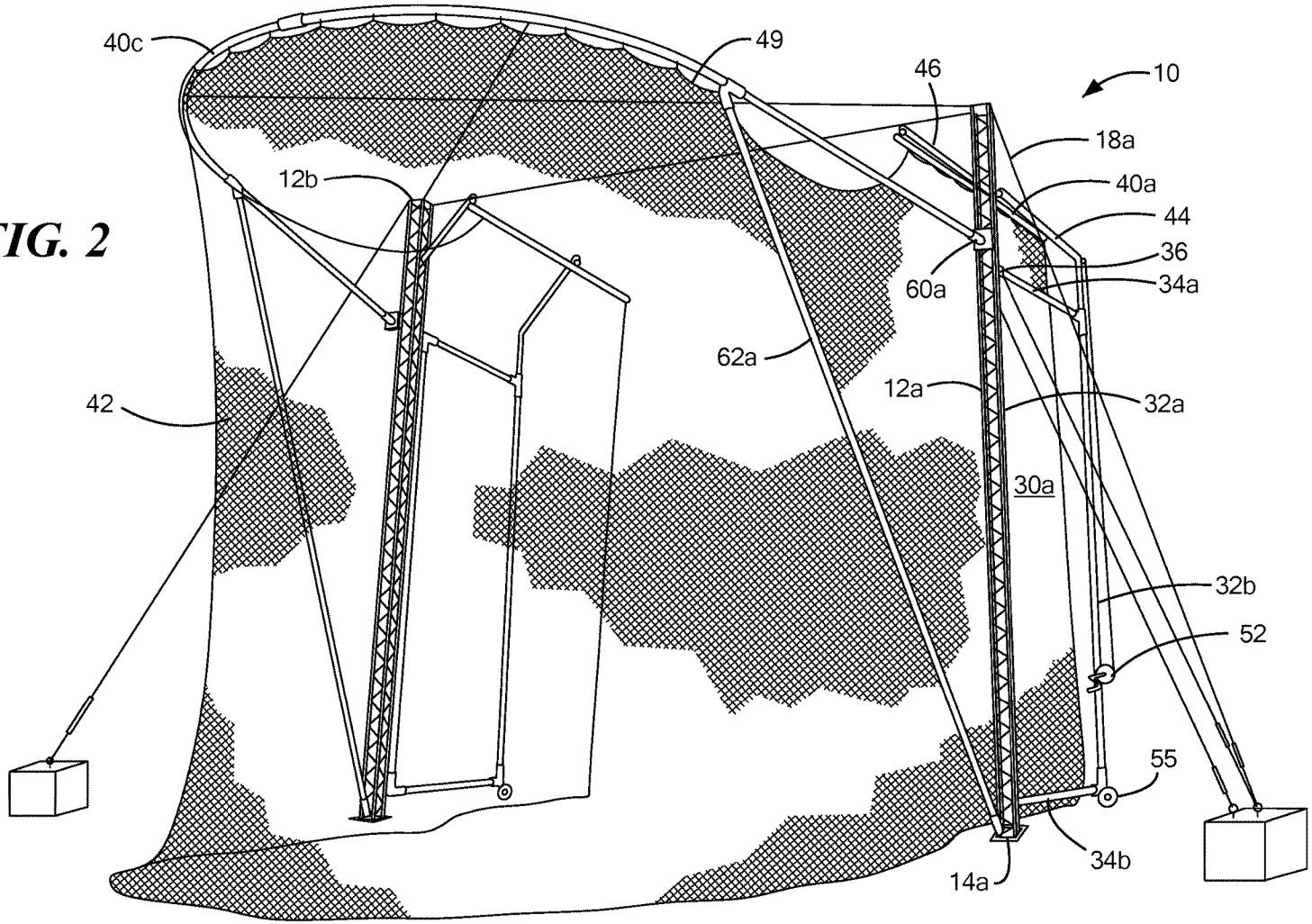
Figure 3:
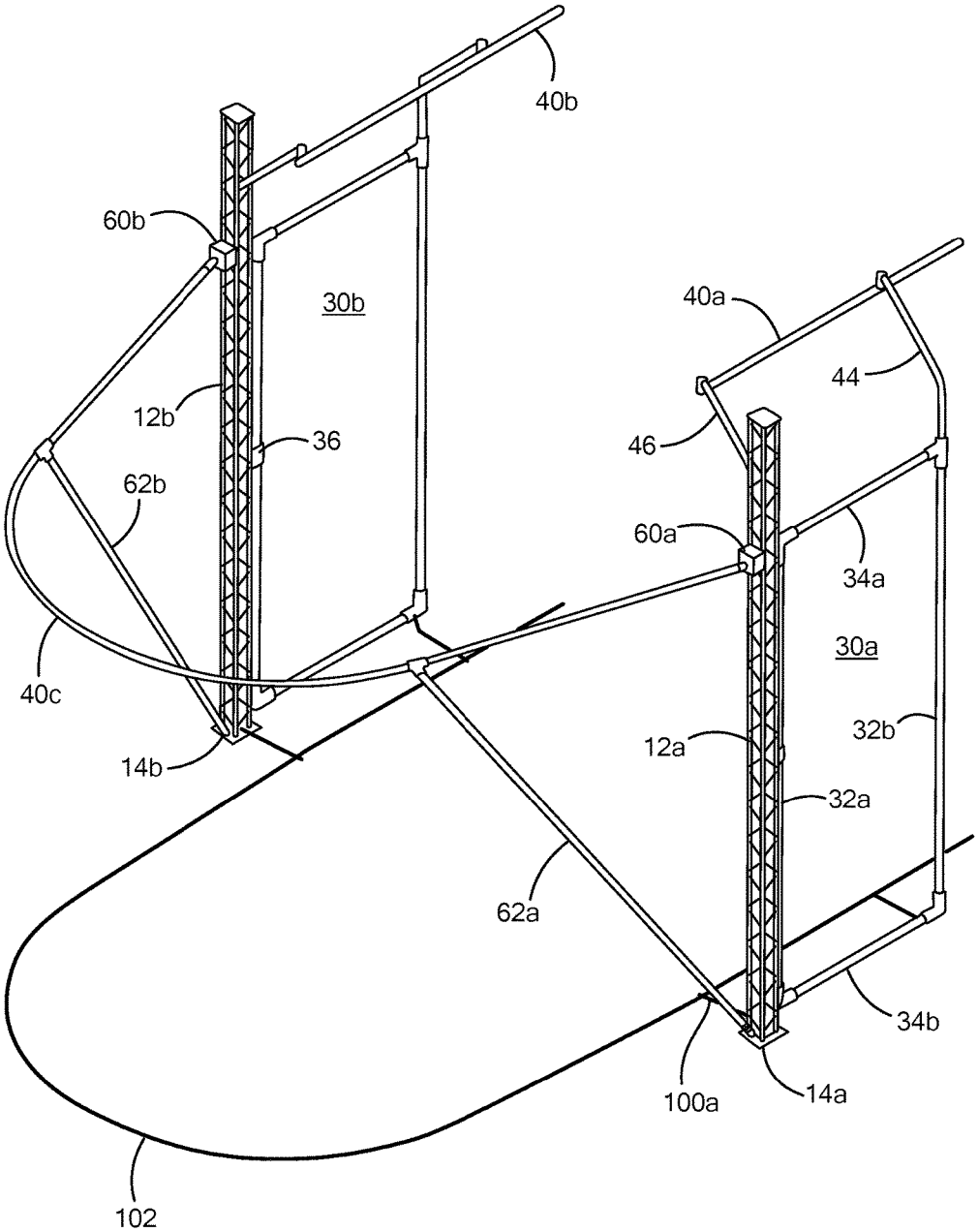

Hammer or discus cage 10, FIGS. 1-3 (depending on the size) includes vertical trusses (e.g., aluminum) 12*a*, 12*b* coupled at their bottom ends to base plates 14*a*, 14*b* preferably in a hinged fashion. The three dimensional trusses shown include four vertical posts with web members between them. The base plates typically rest on the ground and may optionally be staked to the ground. The trusses are hinged to the base plates for an erection and collapse of the trusses. But, after erection of the trusses, the bottom of the trusses may be locked with respect to their corresponding base plates using fasteners. In this way, the trusses can be erected and lowered easily without the need for heavy equipment.

Trusses 12*a*, 12*b* are preferably supported by ballast such as concrete blocks 16*a*, 16*b*, 16*c*, and 16*d* along with cables 18*a*, 18*b*, 18*c*, 18*d* extending from each block to at or near the tops of each truss and tightened by turnbuckles (see turnbuckle 20*a*). Cable 18*e* may extend between the top end of each vertical truss 12*a*, 12*b* for further support of the trusses. By cable we mean wire cables and their equivalents (e.g., ropes, straps, and the like). Alternately, a truss or other member may extend between the tops of trusses 12*a* and 12*b*.

Also featured are gates 30*a*, 30*b* hinged to trusses 12*a* and 12*b*. As shown for gate 30*a*, included in one preferred embodiment are vertical posts 32*a*, 32*b* coupled together via upper 34*a* and lower 34*b* rails. Vertical post 32*a* is pivotably attached to truss 12 via three hinges 36. The lower end of vertical posts 54, 32*b* may be equipped with a wheel 55 for maneuvering the gates depending on whether the athlete is right or left handed.

Net rails 40*a* and 40*b* and curved hoop net rail 40*c* support netting 42 which typically includes a top rope 49. Net rails 40*a* and 40*b* are suspended from brackets as shown. For example, angled bracket 44 is secured to gate post 32*b* and angled bracket 46 is secured to truss 12*a*. The terminal end of each angled bracket may include a pulley 48 and additional pulleys 48 may be located at the angled junction of each bracket. Winch 50 is supported at the lower end of gate post 32*b* and winch 52 is supported at the lower end of truss 12*a*. Cables such as cable 54 extends from winch 50, around pulleys 48, and is secured to net rail 40*a*. The same is true with respect to winch 52. The net rail 40*b* on the other side of the cage is supported in a similar fashion and gate 30*b* is preferably constructed the same as gate 30*a*. In this way, the hand crank of the winches 50, 52 can be operated to raise and lower net rails 40*a*, 40*b* and the netting attached to it.

Net rail 40*c* which curves rearwardly from truss 12*a* to trust 12*b* may be coupled to trusses 12*a*, 12*b* via U-joints 60*a*, 60*b*. Strut members 62*a*, 62*b* may each extend from the bottom of a truss base plate rearwardly at an angle to join with the curved net rail 40*c*. In this way, net rail 40*c* is easily raised and lowered. Additionally, cables (see for example cable 64) may extend from the top of each vertical truss to curved net rail 40*c* for additional support of the curved net rail. A cable may also extend from the top of each truss to its respective gate. See cable 66 extending from the top of truss 12*b* to the junction of post 31*b* and rail 33*a*.

In this way, the whole cage can be raised and lowered relatively quickly and without the use of heavy machinery. Concrete footings are not typically required and thus the cage is portable. The cage can be collapsed if needed to protect it from the wind and/or for better viewing at a track event by spectators or TV cameras. The gates can be folded in and the trusses can be folded down to the ground relatively easily. The net can also be lowered and/or removed to protect against possible vandalism, theft, or ultraviolet radiation when the cage is not being used. Still, in some installations, concrete footings may be used.

Figure 4:
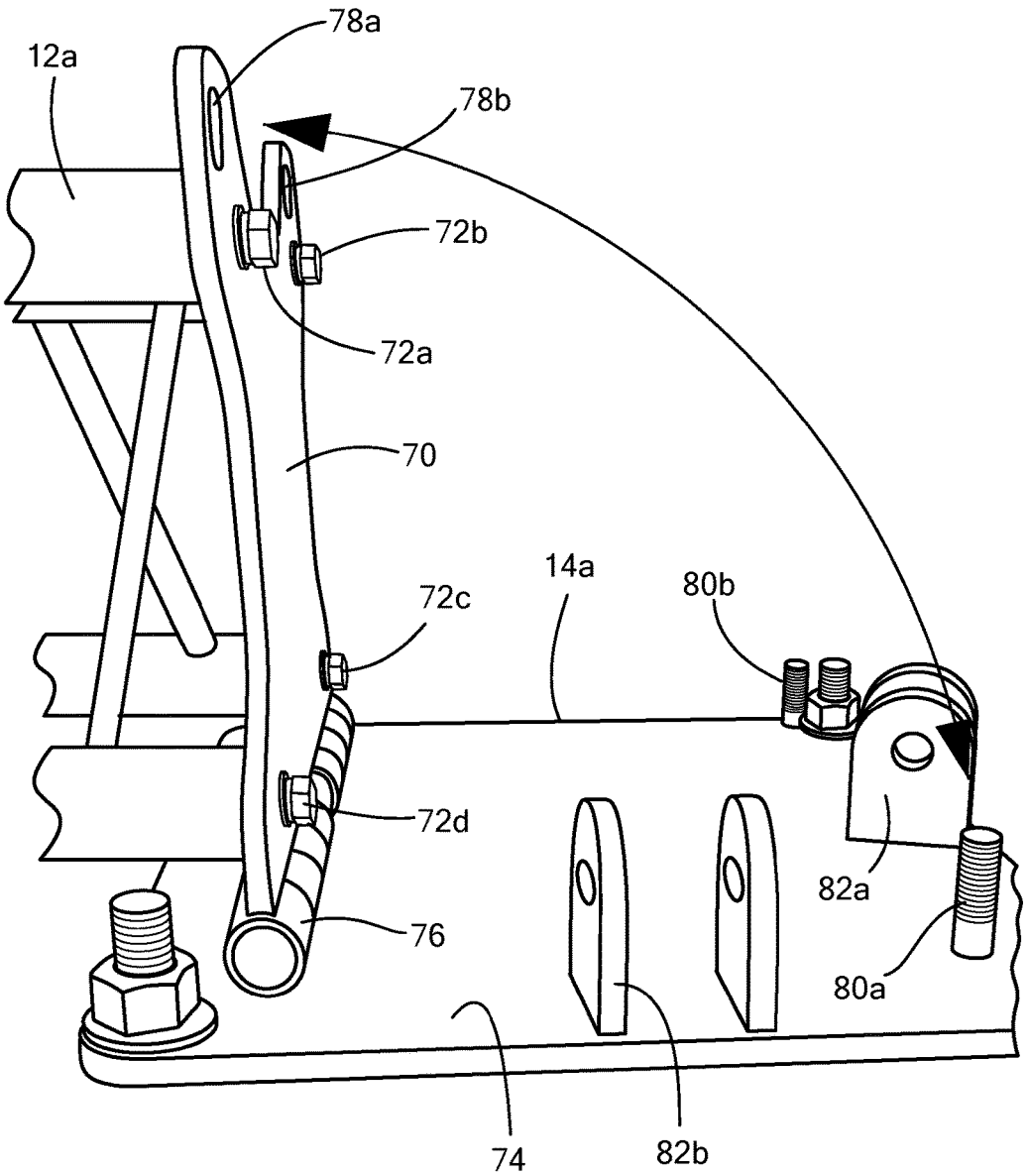
FIGS. 4-5 are views of a truss structure base plate.
Figure 5:
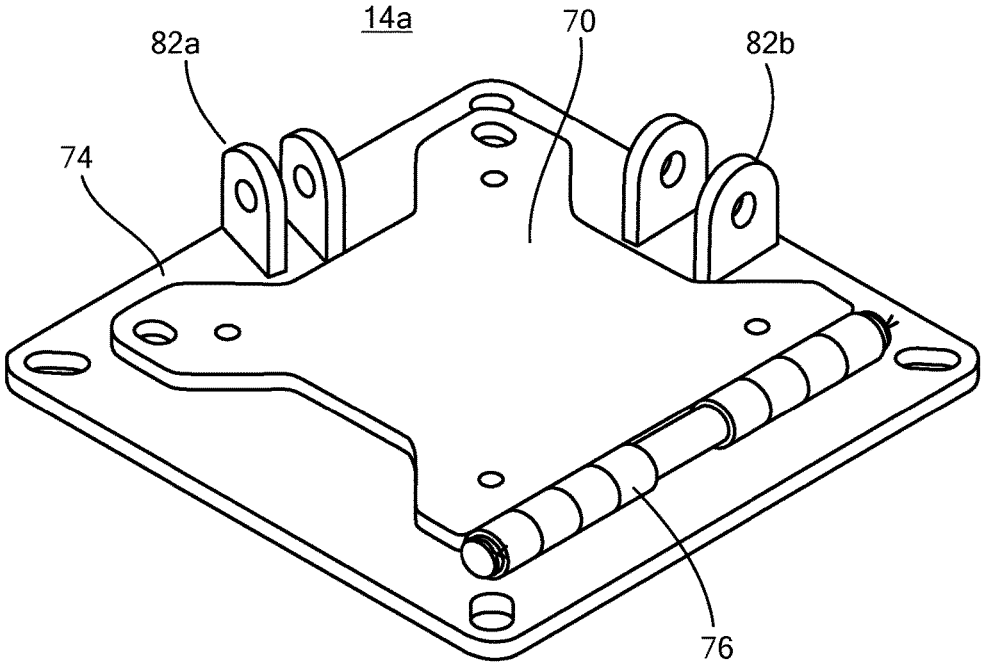

FIGS. 4-5 show an exemplary base assembly for truss 12*a*. The truss structure is bolted to hinged member 70 via fasteners 72*a*-72*b*. Member 70 is hinged to bottom plate 74 via hinge 76. When erected, the member 70 holes 78*a*, 78*b* receive bolts 80*a*, 80*b*, respectively therethrough. Two nuts are secured on these bolts to retain member 70 adjacent to and on top of bottom plate 74. One yoke 82*a* extending upwards from bottom plate 74 is for receiving the bottom end of strut 62 (FIG. 1) and another yoke 82*b* is for the bottom net rail standoff 100*a*, FIG. 4 that supports bottom net rib assembly 102.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A hammer/discus cage comprising:

first and second base plates;

first and second vertical trusses coupled to their respective first and second base plates;

first and second gates hinged to their respective first and second vertical trusses;

a hoop net rail extending rearwardly from the first vertical truss to the second vertical truss; and netting extending downward from the hoop net rail and attached to the first and second gates.

2. The cage of claim 1 further including ballast secured to the first and second vertical trusses.

3. The cage of claim 2 further including a member extending between the first and second vertical trusses.

4. The cage of claim 1 in which each gate includes a top rail and a bottom rail hingely attached to a vertical truss and at least one gate vertical post connected to the top and bottom rails.

5. The cage of claim 4 in which each gate includes a net rail attached to the netting.

6. The cage of claim 5 in which the gate net rail is supported by one or more cables for lowering the gate net rail.

7. The cage of claim 6 further including an angled bracket attached to the gate vertical post and an angled bracket attached to the vertical truss supporting the gate net rail via said one or more cables.

8. The cage of claim 1 further including a strut extending from each base plate to the hoop net rail.

9. The cage of claim 1 further including one or more cables extending from each truss to its respective gate.

10. The cage of claim 1 further including one or more cables extending from each truss to the hoop net rail.

11. The cage of claim 1 further including a bottom rib assembly for the netting.

12. The cage of claim 1 in which each vertical truss is hingedly attached to its respective base plate.

13. A hammer/discus cage comprising:

first and second base plates;

first and second vertical trusses coupled to the respective first and second base plates;

first and second gates each including a top rail and a bottom rail hingely attached to a vertical truss and at least one vertical post connected to the top and bottom rails;

first and second gate net rails supported by brackets;

a hoop net rail extending rearwardly from the first vertical truss to the second vertical truss; and netting extending downward from the hoop net rail and each gate net rail.

14. The cage of claim 13 further including ballast secured to the first and second vertical trusses.

15. The cage of claim 13 in which the first and second vertical trusses are tied together.

16. The cage of claim 13 in which the first and second net rails are supported by one or more cables for lowering the first and second net rails via winches.

17. The cage of claim 13 further including one or more struts supporting the hoop net rail.

18. The cage of claim 13 further including one or more cables extending from each truss to its respective gate.

19. The cage of claim 13 further including one or more cables extending from each truss to the hoop net rail.

20. The hammer/discus cage comprising:

first and second base plates each including a bottom plate with a top member hinged thereto, the top member releasably lockable to the bottom plate;

a vertical truss fastened to the top member of each base plate;

a hoop net rail supported by the vertical trusses;

a gate hingedly attached to each vertical truss; and netting supported by the first and second gates and the hoop net rail.

21. The cage of claim 20 further including a first and second hoop net rail trusses supporting the hoop net rail.

22. The cage of claim 21 in which the first base plate further includes a receiving structure for the first hoop net rail truss and in which the second base plate further includes a receiving structure for the second hoop net rail truss.

23. The cage of claim 22 in which said receiving structure includes a yoke.

24. The cage of claim 20 further including a bracket on each gate supporting a gate net rail itself supporting the netting.

25. The cage of claim 20 further including at least one cable between each vertical truss and its respective gate.

26. The cage of claim 20 in which the hoop net rail is attached to the vertical trusses via u-joints.

* * * * *